US009986837B2

(12) United States Patent
Czumaj-Bront

(10) Patent No.: US 9,986,837 B2
(45) Date of Patent: Jun. 5, 2018

(54) CHAIR ASSEMBLY WITH EXTENDED SURFACE

(71) Applicant: Haworth, Inc., Holland, MI (US)

(72) Inventor: Nicolai Czumaj-Bront, Berlin (DE)

(73) Assignee: Haworth, Inc., Holland, MI (US)

( * ) Notice: Subject to any disclaimer, the term of this patent is extended or adjusted under 35 U.S.C. 154(b) by 0 days. days.

(21) Appl. No.: 14/777,041

(22) PCT Filed: Mar. 12, 2014

(86) PCT No.: PCT/US2014/024554
§ 371 (c)(1),
(2) Date: Sep. 15, 2015

(87) PCT Pub. No.: WO2014/150923
PCT Pub. Date: Sep. 25, 2014

(65) Prior Publication Data

US 2016/0022043 A1 Jan. 28, 2016

Related U.S. Application Data

(60) Provisional application No. 61/789,319, filed on Mar. 15, 2013.

(51) Int. Cl.
*A47B 39/00* (2006.01)
*A47C 7/02* (2006.01)
(Continued)

(52) U.S. Cl.
CPC ..... *A47C 7/02* (2013.01); *A47B 1/05* (2013.01); *A47C 3/18* (2013.01); *A47C 7/004* (2013.01);
(Continued)

(58) Field of Classification Search
CPC ..... A47C 7/008; A47C 7/006; A47C 7/004; A47C 11/005; A47C 3/18; A47C 7/62; A47C 7/02; A47C 7/024; A47B 1/05
(Continued)

(56) References Cited

U.S. PATENT DOCUMENTS 1,423,661 A * 7/1922 Henderson ..... A47B 39/00 297/171
1,659,572 A * 2/1928 Klemm ..... A47C 7/68 108/23
(Continued)

FOREIGN PATENT DOCUMENTS

| | | |
|---|---|---|
| DE | 20216311 | 2/2003 |
| KR | 20110061029 | 6/2011 |
| WO | 2007119243 | 10/2007 |

OTHER PUBLICATIONS

International Search Report and Written Opinion dated Sep. 10, 2014, International Application No. PCT/US2014/024554.

*Primary Examiner* — Chi Q Nguyen
(74) *Attorney, Agent, or Firm* — Warner Norcross + Judd LLP

(57) ABSTRACT

A seating unit (10) combines lounge seating with work space. A chair portion (20) has a sitting surface with an extended wing (25) and an optional sliding desk (40, 140) as a work surface. The extended wing (25) provides a place to rest personal belongings within easy reach while the user sits or works in the seating unit (10). An optional ottoman (50) may be used as a conventional ottoman or as a seating location on its own. The ottoman (50) has a slidable tray that can provide additional work surface or space to rest additional personal items while the user sits or rests in the unit. Several chair portions (20) may be supported together in a row with extended wings (25) and/or slidable desks on the ends.

11 Claims, 10 Drawing Sheets

(51) Int. Cl.

| | |
|---|---|
| ***A47C 7/00*** | (2006.01) |
| ***A47C 7/68*** | (2006.01) |
| ***A47C 11/00*** | (2006.01) |
| ***A47B 1/05*** | (2006.01) |
| ***A47C 3/18*** | (2006.01) |
| ***A47C 7/62*** | (2006.01) |

(52) U.S. Cl.
CPC ..... *A47C 7/62* (2013.01); *A47C 7/68* (2013.01); *A47C 11/005* (2013.01)

(58) Field of Classification Search
USPC ..... 297/149, 144, 142, 172, 174 R, 173, 297/188.01, 248, 233; 108/69, 161
See application file for complete search history.

(56) References Cited

U.S. PATENT DOCUMENTS 2,164,715 A * 7/1939 Krainbill ..... A47C 13/005 297/115
2,503,543 A * 4/1950 Caston ..... A47B 83/02 108/50.11
2,579,606 A * 12/1951 Oom ..... A47B 39/02 16/333
2,747,654 A 5/1956 Chapman et al.
4,238,097 A 12/1980 Boeddeker et al.
5,035,464 A * 7/1991 Spallholtz ..... A47C 7/62 297/144
5,169,210 A * 12/1992 Fricano ..... A47C 7/70 248/282.1
5,282,671 A * 2/1994 Funk ..... A47C 7/543 297/145
5,466,041 A * 11/1995 Hoffman ..... A47C 7/62 297/188.1
5,575,534 A 11/1996 Yu
5,816,649 A * 10/1998 Shields ..... A47B 13/023 297/161
5,893,607 A * 4/1999 Trimnell ..... A47C 7/70 108/27
5,954,393 A * 9/1999 Perrin ..... A47C 7/70 297/161
6,224,149 B1 * 5/2001 Gevaert ..... A47C 7/70 297/160
6,270,157 B1 * 8/2001 Kapushinski ..... A47B 83/02 297/170
6,347,590 B1 * 2/2002 D'Annunzio ..... B60N 3/002 108/25
6,460,930 B2 * 10/2002 Thornton ..... A61G 5/006 297/173
D497,261 S * 10/2004 Epp ..... D6/336
7,695,061 B2 * 4/2010 Olarte ..... A47C 7/70 297/162
7,997,531 B2 * 8/2011 Bettell ..... B64D 11/00 244/118.6
8,011,723 B2 * 9/2011 Park ..... B60N 2/345 244/118.6
8,419,124 B2 * 4/2013 Kramer ..... A47C 7/62 297/116
D718,542 S * 12/2014 Czumaj-Bront ..... D6/338
D731,192 S * 6/2015 Sorel ..... D6/338
9,216,665 B2 * 12/2015 Herault ..... B60N 2/00
2005/0140187 A1 * 6/2005 Kordecki ..... A47C 7/70 297/162
2006/0097553 A1 * 5/2006 Spurlock ..... B64D 11/06 297/248
2007/0284920 A1 * 12/2007 Mehaffey ..... A47C 3/045 297/162
2008/0231091 A1 * 9/2008 Goranson ..... A47C 7/70 297/135
2010/0231009 A1 * 9/2010 Chi ..... A47C 7/407 297/155
2010/0252680 A1 * 10/2010 Porter ..... B60N 2/01 244/118.6
2011/0187164 A1 * 8/2011 Corcorran ..... A47B 39/00 297/170
2012/0126588 A1 5/2012 Barile

* cited by examiner

CHAIR ASSEMBLY WITH EXTENDED SURFACE

FIELD OF THE INVENTION

The present invention relates to a chair assembly including an extended surface of a seat.

BACKGROUND OF THE INVENTION

Seating and surface arrangements are commonly offered as a separate table and chair. For example, a side table or coffee table is often placed near a chair or sofa and provides a place to rest one's belongings or for use briefly as a working or writing surface. In some cases, these types of furniture arrangements may be undesirable as a work station because the seating surface is not ergonomically or conveniently positioned with respect to the separate table, especially when the user desires to utilize the separate table for a writing or work surface. A user may be required to twist or bend awkwardly in order to remain seated while working and writing on the surface of the table. Another potential drawback to side tables and coffee tables is the placement of the support legs of these tables in areas where space may be limited or where there may be heavier foot traffic.

Several useful combinations of chair and work surface are well known, such as desks commonly found in classrooms. One such desk provides a combination chair/desk unit that includes a chair joined to the desk with a beam or base that extends between the chair and desk. Another arrangement combining a seating surface and desk space includes a chair with a fixed flat work surface extending from an arm of the chair. Auditorium style seating sometimes have a moveable writing surface that pivots from a storage position along the side of the seat to a use position in front of a seated user and serves as a temporary work surface. The work surface provides a place the person may rest items and/or provide a working surface, such as a surface for taking notes during a meeting or presentation, etc., while the person is sitting in the chair. Unfortunately, these work surfaces must generally be pivoted open before a person can exit the seat, requiring the person to remove all the items on the work surface before moving from the seat.

Several known chair and work surface units have a single, fixed position. Because different people vary in size and preferred work position, adjustability is desired. Some known work surfaces include chairs or work surfaces that pivot from a use position to an exit position. While the chair or work surface is pivoted in the exit position, the user may more easily enter or exit the chair. Generally, these chair and work surface combinations are not adjustable in the use position and do not provide an easily accessible surface for belongings that the user may want at close reach.

The current state of technology is such that employment arrangements allow workers to perform duties of their employment from a variety of locations such as an office, studio, airport or at home, etc. Various styles of work spaces aside from standard desks are becoming common. For example, open plan seating, conference areas or other group collaboration areas are desired.

Although existing seating arrangements are suitable for many work situations, there remains a desire for a seating arrangement suitable for a person to sit and work for a few minutes to a few hours as well as to provide ample space for their various work tools, technology accessories, drinks, food, casual reading materials and other personal items so that the work tools and personal items are all within an easy reach. It is further desired to provide lounge type seating combined with adequate space for work tools and/or technical devices and other personal belongings.

SUMMARY OF THE INVENTION

The present invention provides a seating unit that includes a readily accessible space for personal belongings and a convenient work space. In one embodiment, the seating unit includes a wing extending generally horizontally from an edge of the seating surface. The seating surface is supported by a chair base affixed to a bottom side of the seating surface. A work surface may extend from a side of the seating surface opposite the horizontally extended wing.

In one embodiment, the chair base includes a plurality of legs extending from a pedestal for supporting the seating surface and wing. A pair of longer legs may extend from the pedestal in the direction of the wing, and in one embodiment the longer legs may extend outwardly to a position wherein portions of these legs are vertically aligned under the extended wing. In this way, the longer legs can provide support and balance for any substantial weight that may be placed on the wing.

In another embodiment, the seating surface of the seating unit maybe configured to swivel with respect to the base over a range of rotation. In a further embodiment, this range the rotation is limited to restrict the travel of the seating surface, particularly the extended wing, to prevent the wing from rotating beyond positions that are vertically above at least one of the pair of longer legs.

In another embodiment, the seating unit has a separate ottoman. The ottoman has a horizontal surface supported by a base and a tray mounted on a side of the ottoman opposite said horizontal surface. The tray is moveable from a position under said ottoman to a position substantially adjacent said ottoman.

In one embodiment, the seating unit includes a plurality of chair portions including a first end seat and a second end seat. An extended wing is adjacent the sitting surface of the first end seat and a pair of bases support the first and second end seats. A beam adjoins the pair of bases supporting the seats.

The present invention provides a simple and effective seating or lounge arrangement in which a person may work for a few minutes or a few hours with ample space for their tools or belongings. The assembly is adjustable to fit a variety of sizes of user and can accommodate a wide range of preferred work positions. Further, the legs of seating unit are provided substantially directly beneath the chair portion of the seating unit resulting in a reduce footprint for the unit.

These and other features of the invention will be more fully understood and appreciated by reference to the description of the embodiments and the drawings.

Figure 1:
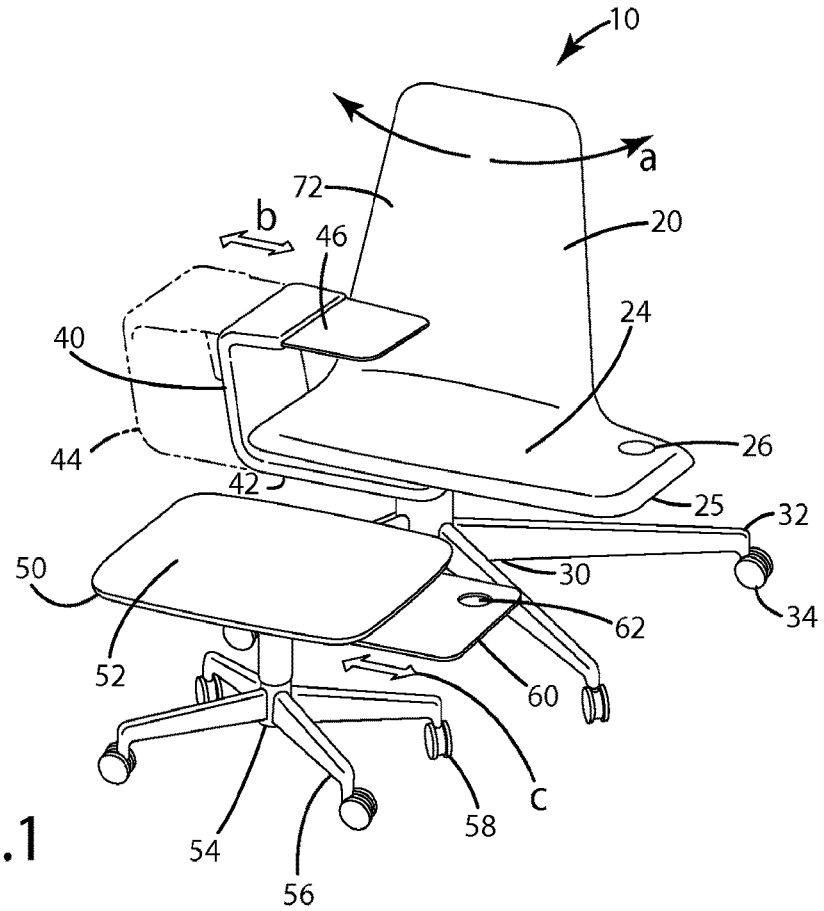
FIG. 1 is a perspective view of the chair assembly with an upholstered chair with an extended wing, upholstered ottoman and work surface.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF CURRENT EMBODIMENTS

A seating unit in accordance with an embodiment of the invention is shown in FIGS. 1 and 6-12 and is generally designated 10. The seating unit 10 has a chair portion 20 with a seating or sitting surface 24 and a vertically extending back support 22. A horizontally extending wing 25 projects from one edge of the sitting surface 24. Optionally, an opening or cup 26 is defined in the extended wing 25 and can serve as a cup holder for beverages, phones, pens, markers etc. The cup 26 may alternatively be raised above the sitting surface 24 rather than disposed within the sitting surface 24. The chair portion 20 is supported on a pedestal base 30 with a plurality of outwardly extending legs 32, 33. The chair portion 20 is connected to the base 30 on the underside of the sitting surface 24 and is capable of swiveling on the base as indicated by arc "a".

In one embodiment, the chair portion 20 of the seating unit 10 includes a sliding work desk 40 that has a connecting plane 42 connected to the underside of the sitting surface 24. The sliding work desk 40 includes a vertical support member 44 joined to the distal end of the connecting plane 42 relative to the base 30. The vertical support member 44 supports a cantilevered work surface 46. The sliding work desk 40 is slidably attached to the underside of the sitting surface 24 on a track (not shown) or other means known in the art and is capable of moving over a range of positions in the direction indicated as "b" in FIG. 1.

It should be understood that the extended wing 25 may be adjacent either side of the sitting surface 24. Similarly, the sliding work desk 40 may be situated to slide at least partially over the sitting surface 24 from either side of the chair portion 20. These arrangement alternatives for the extended wings and slidable desks can accommodate the different work position preferences for right handed verses left handed users.

The seating unit 10 may optionally include an ottoman 50. In one embodiment, the ottoman 50 has a cushioned surface 52. Similar to the chair portion 20, the ottoman is supported by a pedestal base 54 having legs 56 and casters 58. A tray 60 is slidably attached to the underside of the cushioned surface 52 of the ottoman 50 and is capable of moving over a range of positions in the direction indicated as "c" in FIG. 1. The tray may include a cutout or cup 62. Similar to the chair portion 20, the ottoman may swivel, if desired.

Alternatively or additionally, the ottoman may include a cup holder that is mounted beneath the ottoman and flips out, or pivots, from under the ottoman. The cup holder may be a cutout in the surface of a small tray capable of receiving a cup or similar item, or may be a delineated area for resting a cup in a depression. The delineated area may be constructed of a material different from that of the tray or ottoman, such as but not limited to cast aluminum, etc.

Figure 2:
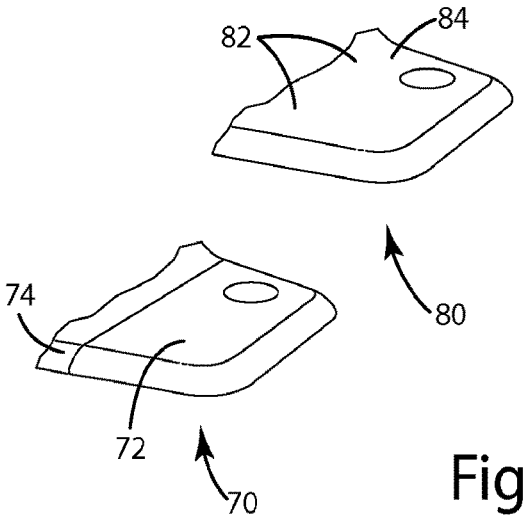
FIG. 2 is a detailed view of two extended wings of the chair.

As shown in FIG. 1, the chair portion 20 including the sitting surface 24, extended wing 25 and cushioned surface 52 of the ottoman 50 are upholstered in the same material such as fabric or leather, but may have different coverings, if desired. Two alternative extended wing constructions 70, 80 are shown in FIG. 2. The extended wing 70 is covered in a non-skid fabric while the adjacent sitting surface 74 is covered in a different material. The extended wing 80 may be covered in the same material as the adjacent sitting surface 84, while a non-skid thread 82 is affixed onto the extended wing 80 by stitching, adhesive or other means. The non-skid material can be a rubberized material and the non-skid thread may be a rubberized thread. It should be understood that non-skid materials are not limited to rubberized materials. Any material or stitch pattern that will aid in providing a surface that will prevent slick objects from easily sliding around or off of the extended wing would be suitable as a covering for the seating unit 10.

Figure 3:
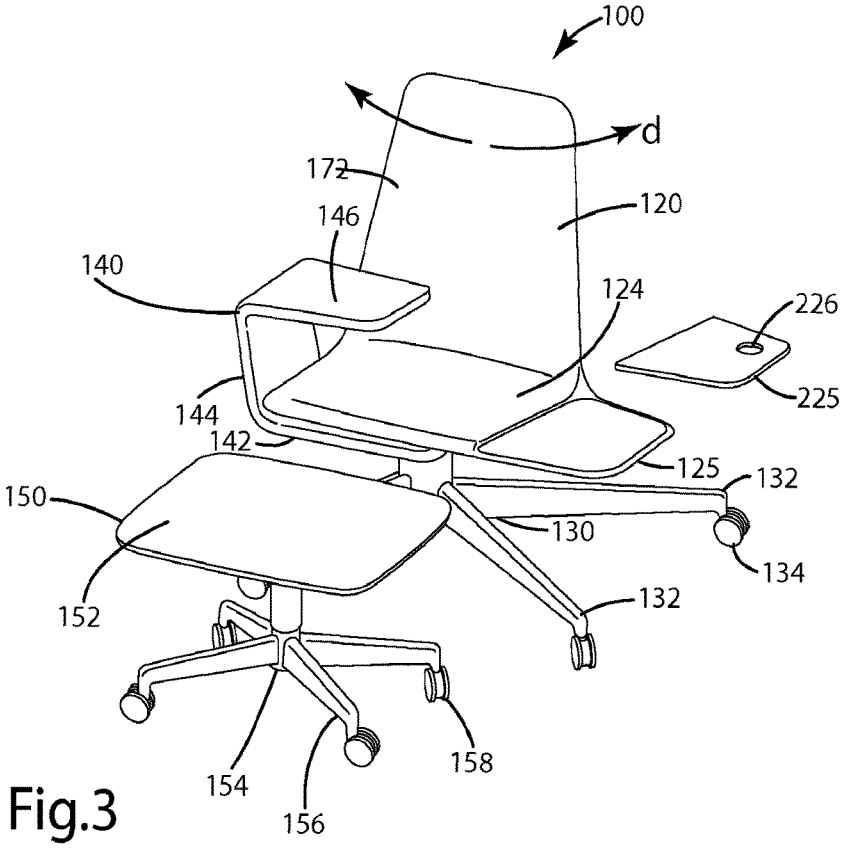
FIG. 3 is a perspective view of an un-upholstered extended wing with a cup holder.

Referring to FIG. 3, in another embodiment, the seating unit 100 has a chair portion 120 with a sitting surface 124 and a vertically extending back 122. The sitting surface 124 may be adjacent a horizontally extended wing 125 or 225. An alternative extended wing 225 is shown with an opening or cup 226 is defined in the extended wing 225 which can serve as a cup holder. The chair 120 is supported on a pedestal base 130 having legs 132 and glides 134. The chair portion 120 is connected to the base 130 on the underside of the sitting surface 124 and is capable of swiveling on the base as indicated by arc "d".

The chair portion 120 of the seating unit 100 includes a sliding work desk 140 that has a connecting plane 142 connected to the chair portion 120 of the seating unit 100 by the underside of the sitting surface 124. The sliding work desk 140 includes a vertical support member 144 joined to the distal end of the connecting plane 142 relative to the base 130. The vertical support member 144 supports a cantilevered work surface 146. The sliding work desk 140 is slidably attached to the underside of the sitting surface 124 on a track or other means known in the art and is capable of moving over a range of positions relative to the user similar to the direction indicated as "b" in FIG. 1.

The seating unit 100 of FIG. 3 may optionally include an ottoman 150. The ottoman 150 has a cushioned surface 152. Similar to the chair portion 120, the ottoman is supported by a pedestal base 154 having legs 156 and sliders 158. A tray (not shown in FIG. 3) can be slidably attached to the underside of the cushioned surface 152 of the ottoman 150 and would be capable of moving over a range of positions similar to the direction indicated as "c" in FIG. 1. The tray may also include a cutout or cup as a cup holder, if desired. Similar to the chair portion 120, the ottoman 150 may swivel.

As shown in FIG. 3, the chair portion 120 including the sitting surface 124, extended wing 25 and cushioned surface 52 of the ottoman 50 may be upholstered in the same material. The extended wing 125, 225 can be un-upholstered and further may be covered with a rubberized or other non-skid material.

Figure 4:
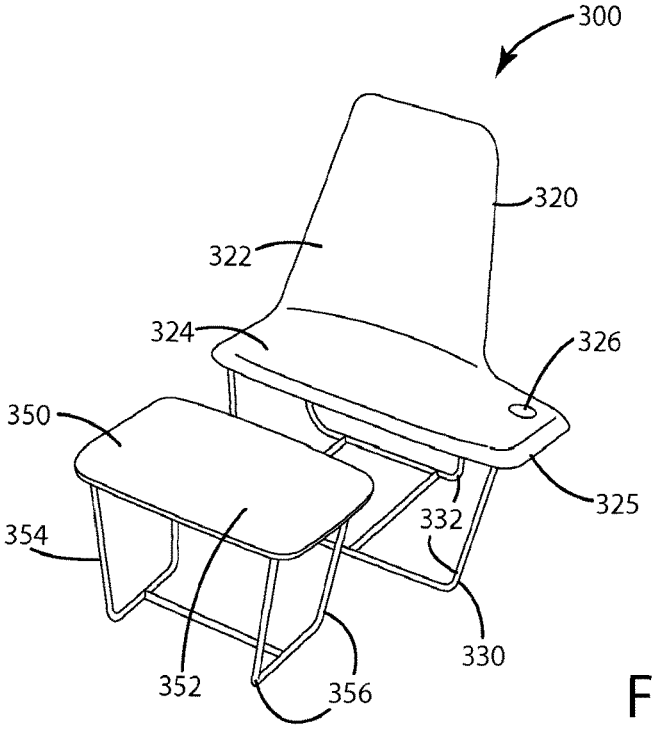
FIG. 4 is a perspective view of the chair assembly with a wire base.

FIG. 4 depicts a seating unit 300 with a chair portion 320 supported by a wire base 330. The chair portion 320 has a sitting surface 324 adjacent a horizontally extending wing 325 and a vertically extending back 322. The extended wing 325 may include a cutout or cup holder 326. The wire base 330 includes substantially vertical portions that serve as legs 332. The chair portion 320 is connected to the base 330 on the underside of the sitting surface 324. Although not shown in FIG. 4, the seating unit 300 may include a sliding desk as described with respect to the seating units 10, 100 of FIGS. 1-3. As with the earlier described seating units 10, 100, the seating unit 300 may optionally include an ottoman 350. The ottoman 150 may have a cushioned surface 352. Similar to the chair portion 320, the ottoman is supported by a wire base 354 having legs 356. A tray (not shown in FIG. 4) can be slidably attached to the underside of the cushioned surface 352 of the ottoman 350 and would be capable of moving over a range of positions similar to the direction indicated as "c" in FIG. 1. The tray may also include a cutout or cup as a cup holder, if desired. The chair portion 320 including the sitting surface 324, extended wing 325 and cushioned surface 352 of the ottoman 350 may be upholstered in the same material or may be covered at least partially with a non-skid material or may include stitching with a non-skid thread.

In use the seating units 10, 100, 300 and 400 (described below) provide lounge chair comfort in a task intensive seating product. The extended wing 25, 125, 225, 325, 425 and sliding work desk 40, 140 provide areas for the user to place or rest items and accessories while also providing space to work, write, use a computer or tablet. The sliding desk 40, 140 can be slid outwardly from the side of the chair portion 20, 120, 320 without changing the orientation of the desk 40, 140 to provide easy ingress and egress from the sitting surface 24, 124, 324 and provide the user the ability to bring their work closer to them or move it away without having to relocate items to change position. As best shown in FIGS. 6-12, the legs 32, 33 are asymmetrical with longer legs 32 extending from the pedestal or base 30 in the direction of the wing 25, such that portions of the longer legs 32 are positioned vertically underneath the extended wing 25 to provide greater stability when the extended wing 25 is occupied by heavier items. One or more shorter legs 33 may extend in direction opposite to the longer legs 33 and may extend under the sitting surface 24. The position of the shorter legs 33 vertically under the sitting surface 24 reduces the floor area required to place and use the seating unit 10, especially as compared to the floor area required for use of units that require support bases under a work surface whether or not the work surface is connected to a chair.

The sitting surface 24 may be defined generally by the perimeter of the sitting surface 24 on all sides except the side that is adjacent the extended wing 25. On the side adjacent the extended wing 25, the sitting surface 24 may have a boundary co-terminating with an edge 27 of the vertically extending back 22. As shown in FIGS. 7, 8, and 10-12, the sitting surface 24 terminates generally along a line 23 representing an edge of the sitting surface and a dividing line between the sitting surface 24 and the extended wing 25, with the wing 25 projecting outwardly from the edge 23. The edge of the sitting surface, represented by line 23, is generally aligned with the edge 27 of the of the back 22, such that the wing 25 projects outwardly from the sitting surface 24 beyond the edge 27 of the back 22. It should be understood that the seating unit 10 may not include a visible line 23, but that line 23, as illustrated in the figures, is an exemplary visual representation of the boundary dividing the an area defined as the sitting surface 24 from the extended wing 25. The exemplary line 23 may vary in angle relative to the origin at the edge 27 of the back 22 and sitting surface 24 depending upon where the line 23 is drawn until reaching the front edge 29 of the sitting surface 24. In the illustrated embodiment, the wing 25 and sitting surface 24 are formed from a single piece of material, such that the wing 25 is integral with the sitting surface 24. As illustrated, the sitting surface defines a width between the first edge 31 and the opposite edge defined generally by line 23, and the wing 25 defines a width (extending in the same direction as the width of the sitting surface) between the line 23 and the distal edge 35 of the wing. The relative widths of the sitting surface and the wing may be predetermined, depending on the desired application. In the illustrated embodiment, the width of the wing 25 is about 50% of the width of the sitting surface.

The chair portion 20, 120 may also rotate to the right or left and has a soft sit cylinder to cushion the placement of the user as the user initially sits on the sitting surface 24, 124. In one embodiment, the rotation of the chair portion 20, 120 may be limited to a particular angle, such as a 20-30 degree angle with respect to the base 30, to prevent over rotation of the extended wing 25, 125. In one embodiment, the rotation of the chair portion 24 is limited to prevent rotation of the wing 25 to a position wherein the wing 25 is no longer supported above one of the longer legs 32. Furthermore, the angle between two of the longer legs 32 may be the same, or roughly the same as, the limited angle of rotation of the chair portion 20, 120, with the limit of one direction of travel positioning the wing 25 above one of the longer legs 32 and the limit of the other direction of travel positioning the wing 25 over the other of the longer legs 32. The swivel movement of seating unit provided by the pedestal base 30, 130 of the seating assembly 10, 100 and the swivel movement of the ottoman 50, 150 provided by its pedestal base 54, 154 may be limited over arcs "a" and "c" by providing conventional limiters (not shown) within the pedestal bases. For example, the swivel action may be limited by providing an outer C-shaped ring within the pedestal and an inner ring with a protrusion that stops the swivel in locations that correspond to the protrusions contacting either open end of the C-shaped outer ring; or by other disc rotational limiters or shaft rotation limiters.

Further, the chair portion 20, 120 may be biased to return to a home position to maintain the extended wing 25, 125, 225 over the longer of the asymmetrical legs 32, 132. The back 22, 122, 322 of the chair portion may flex with the movement of the user to provide another level of comfort.

The ottoman 50, 150, 350, if present, can be used in conjunction with the chair portion 20, 120, 320 or as a seat on its own. The optional tray 60 provides additional surface area for the user to rest belongings or work tools such as phones or notebooks.

Figure 5:
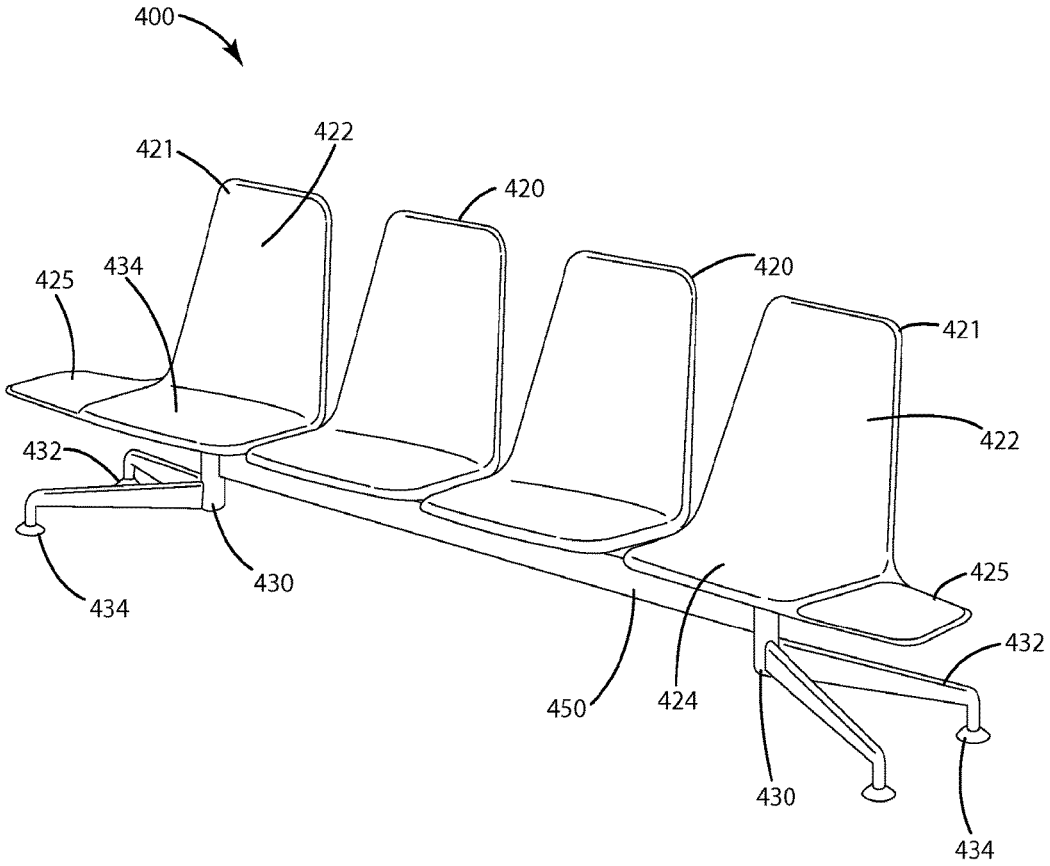
FIG. 5 is a perspective view of the chair assembly with a plurality of seats.
Figure 6:
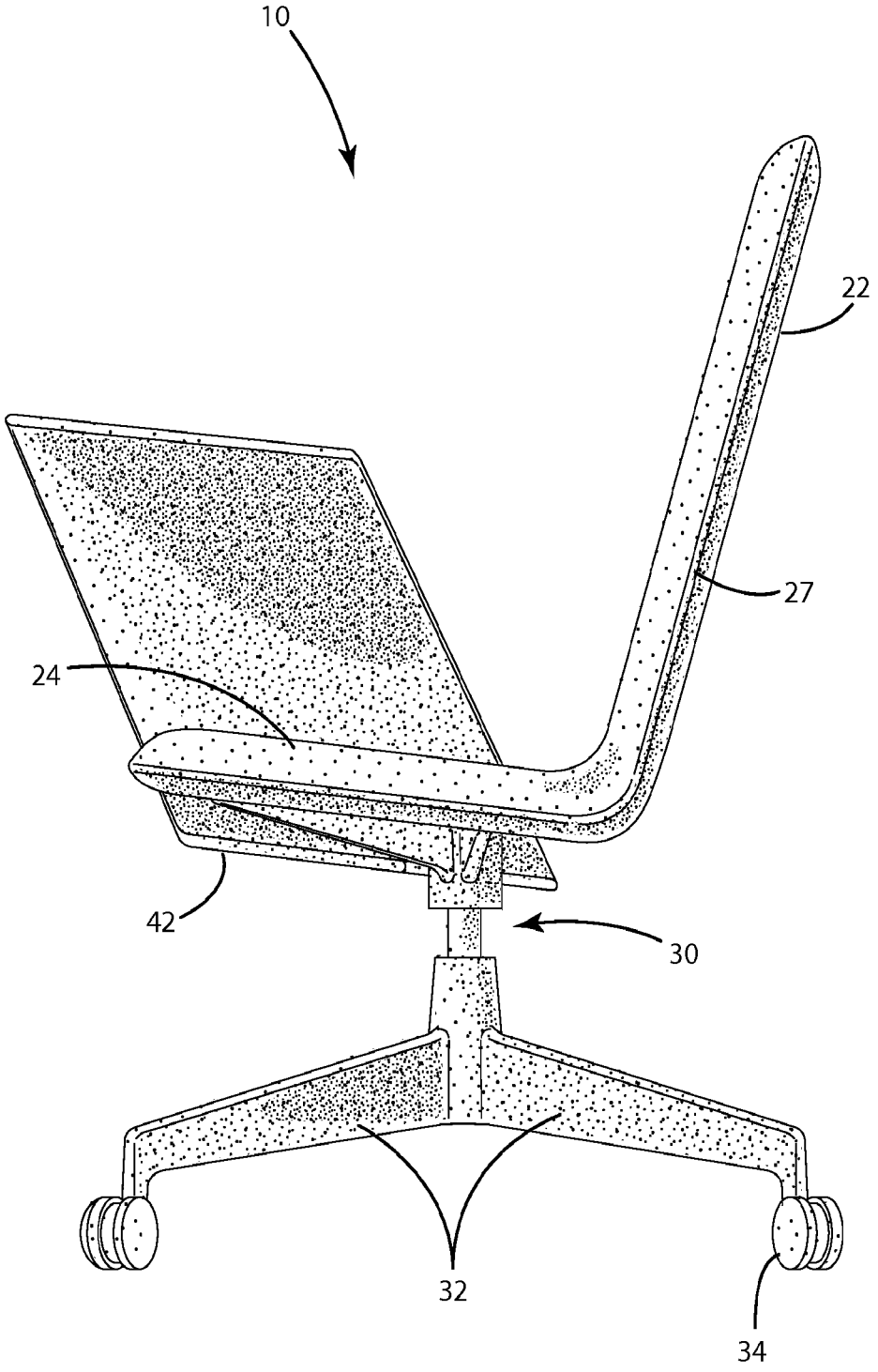
FIG. 6 is a side view of the chair assembly.
Figure 7:
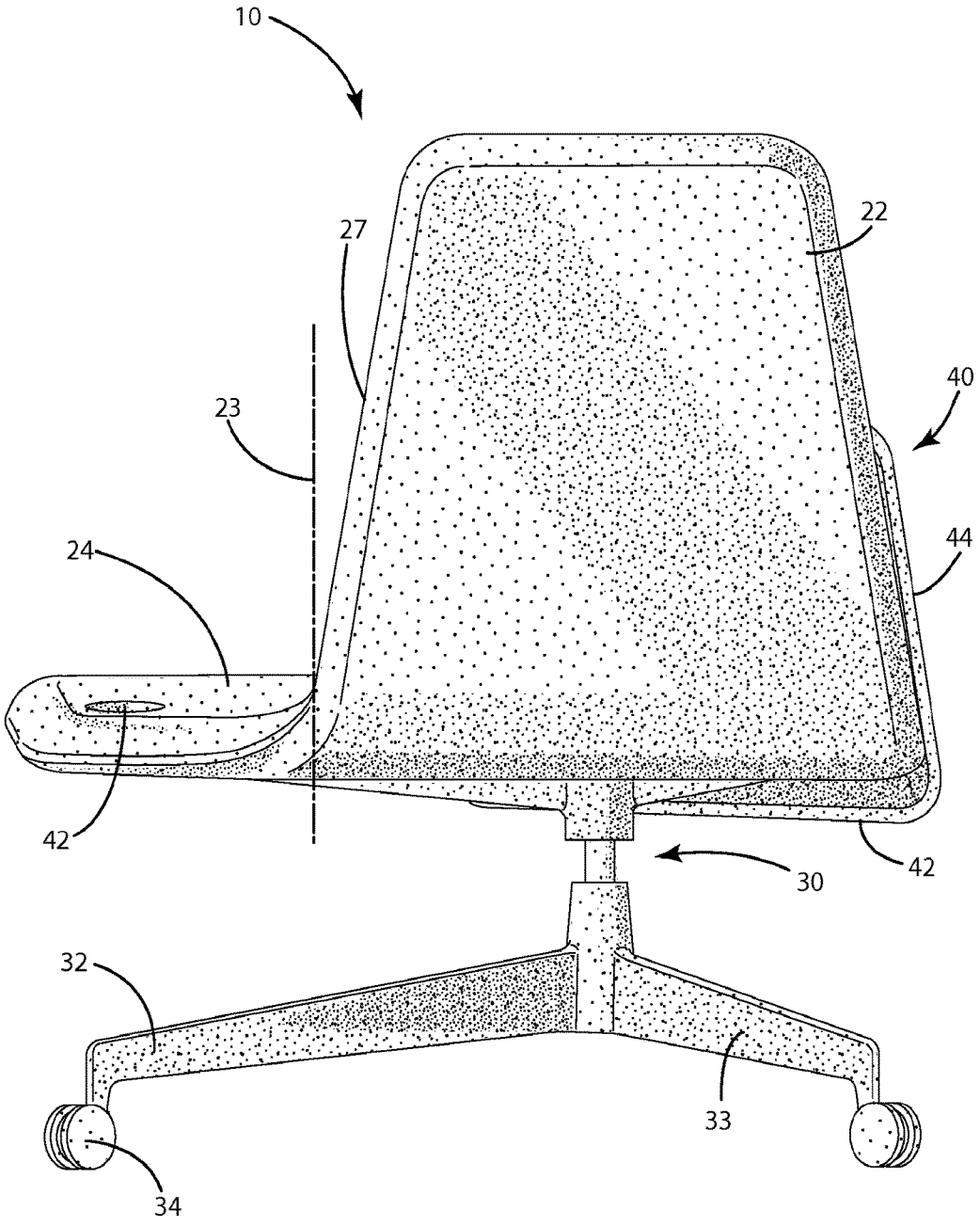
FIG. 7 is a back view of the chair assembly.
Figure 8:
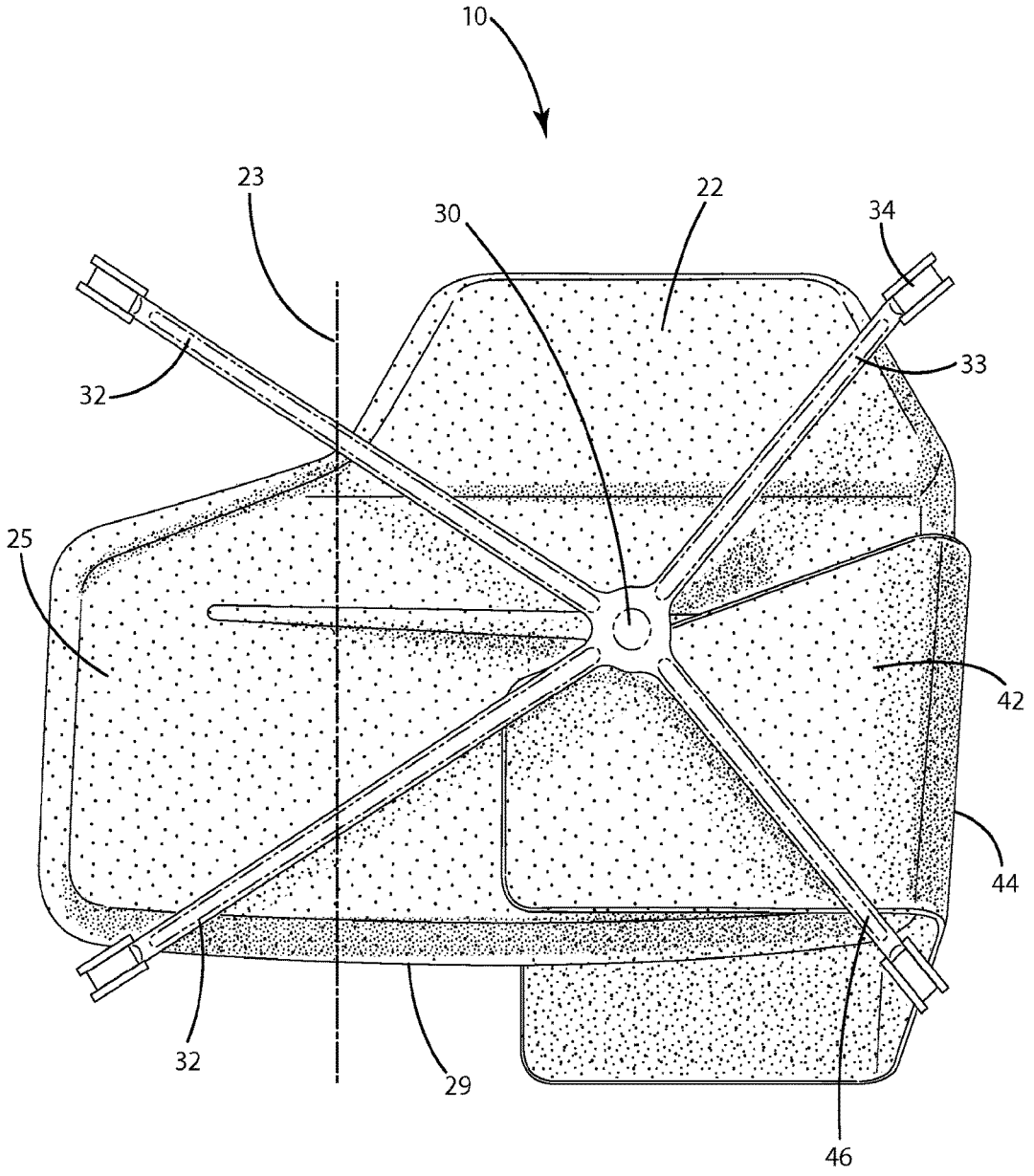
FIG. 8 is a bottom view of the chair assembly.
Figure 9:
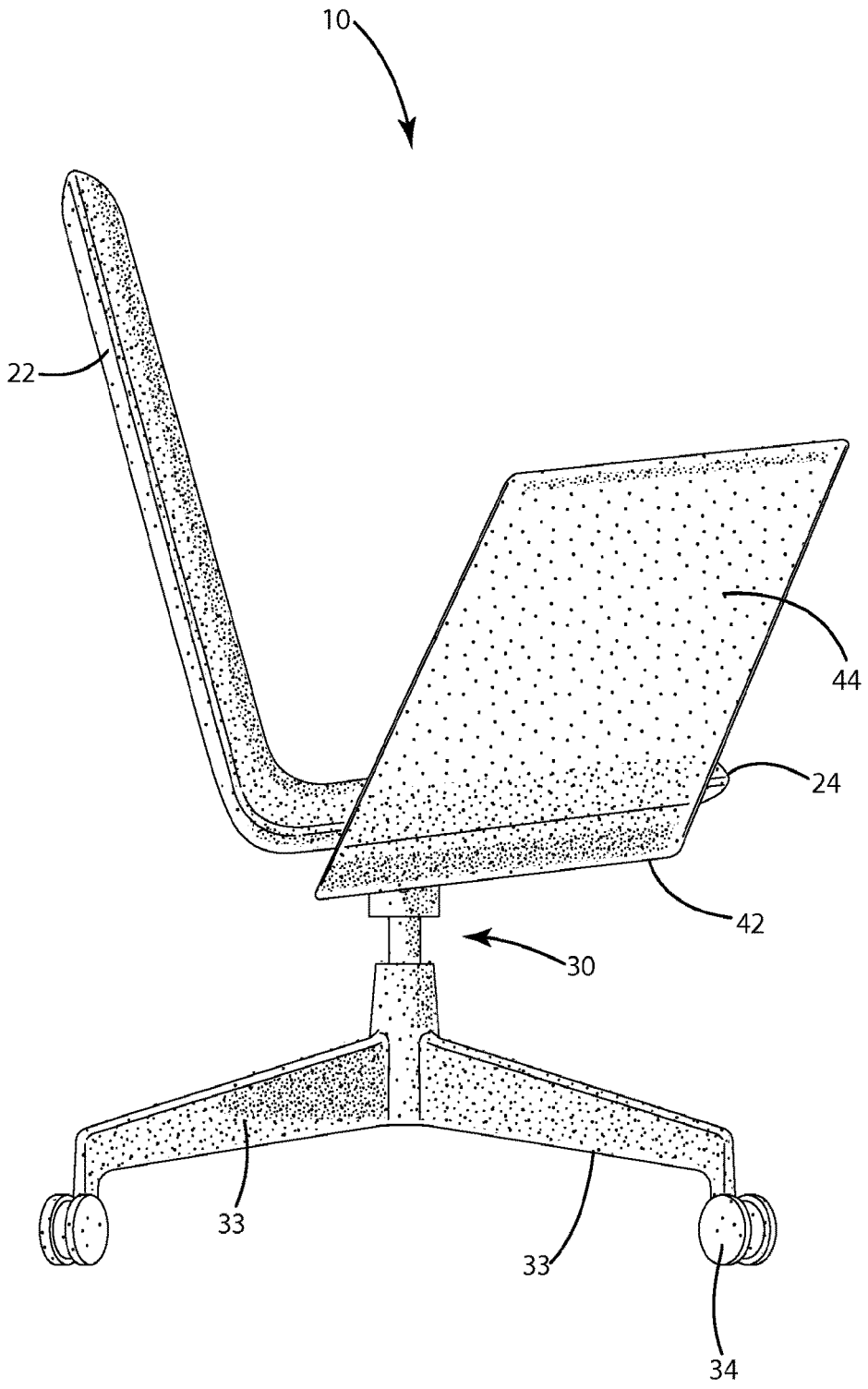
FIG. 9 is a side view of the chair assembly.
Figure 10:
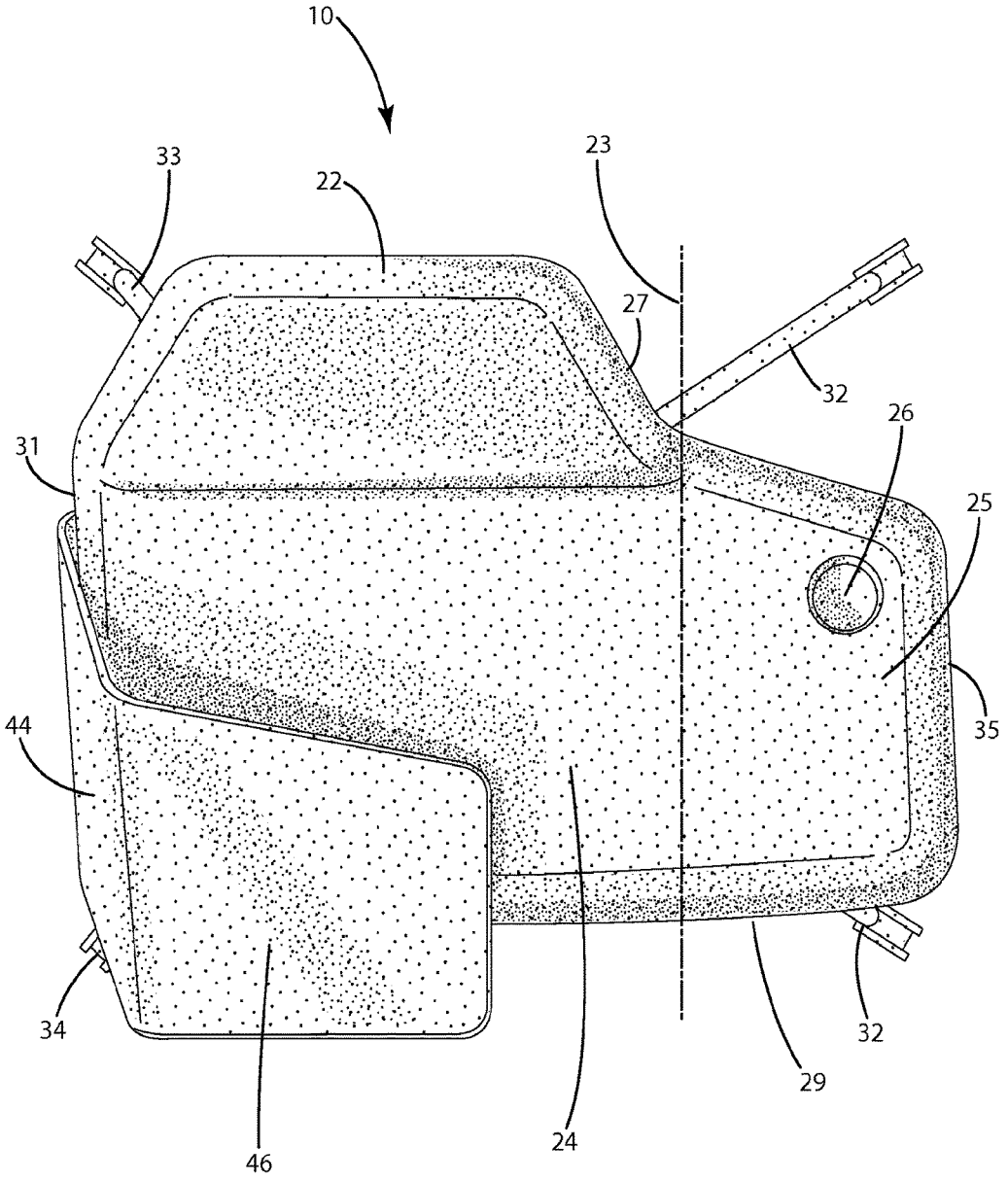
FIG. 10 is a top view of the chair assembly.
Figure 11:
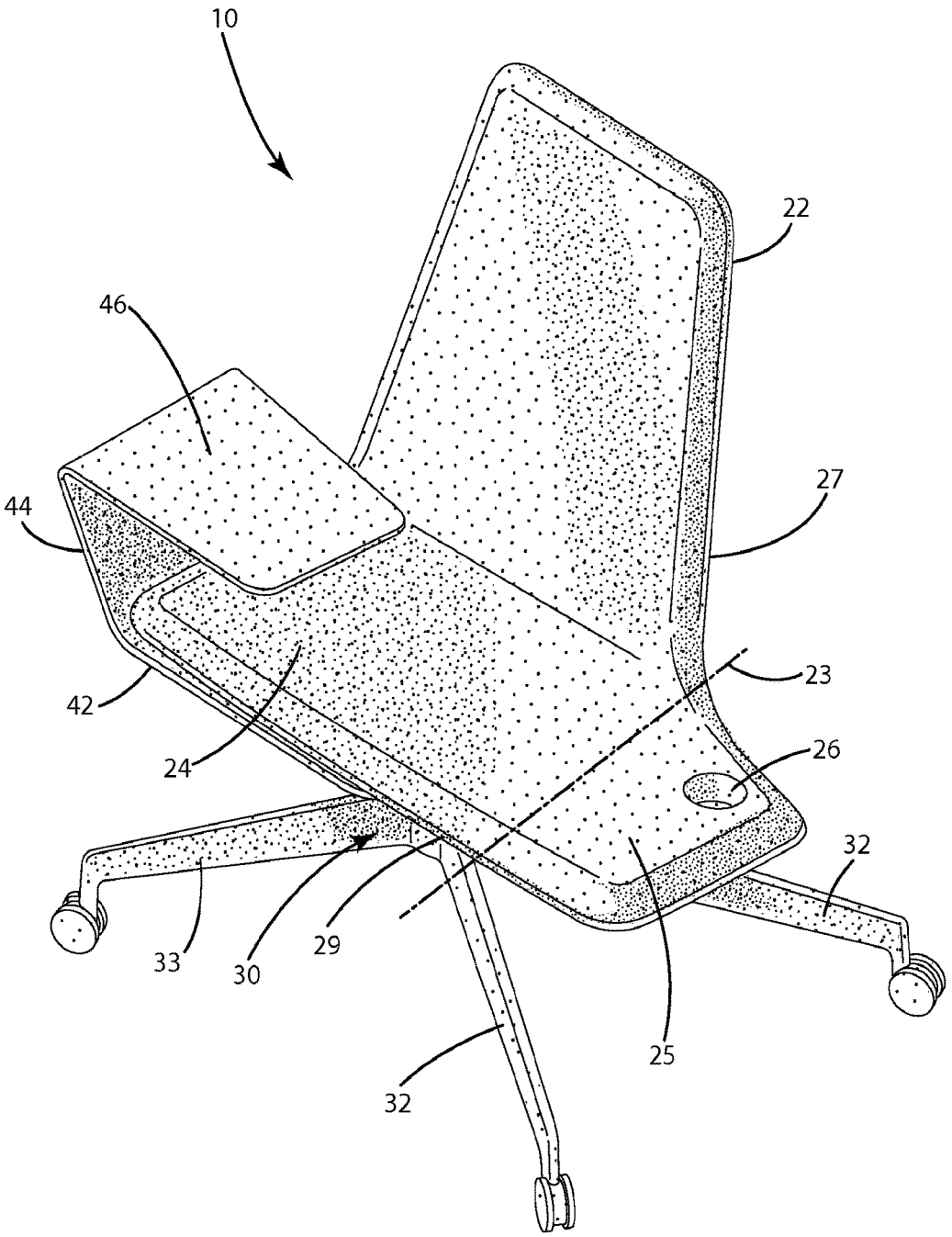
FIG. 11 is a perspective view of the chair assembly.
Figure 12:
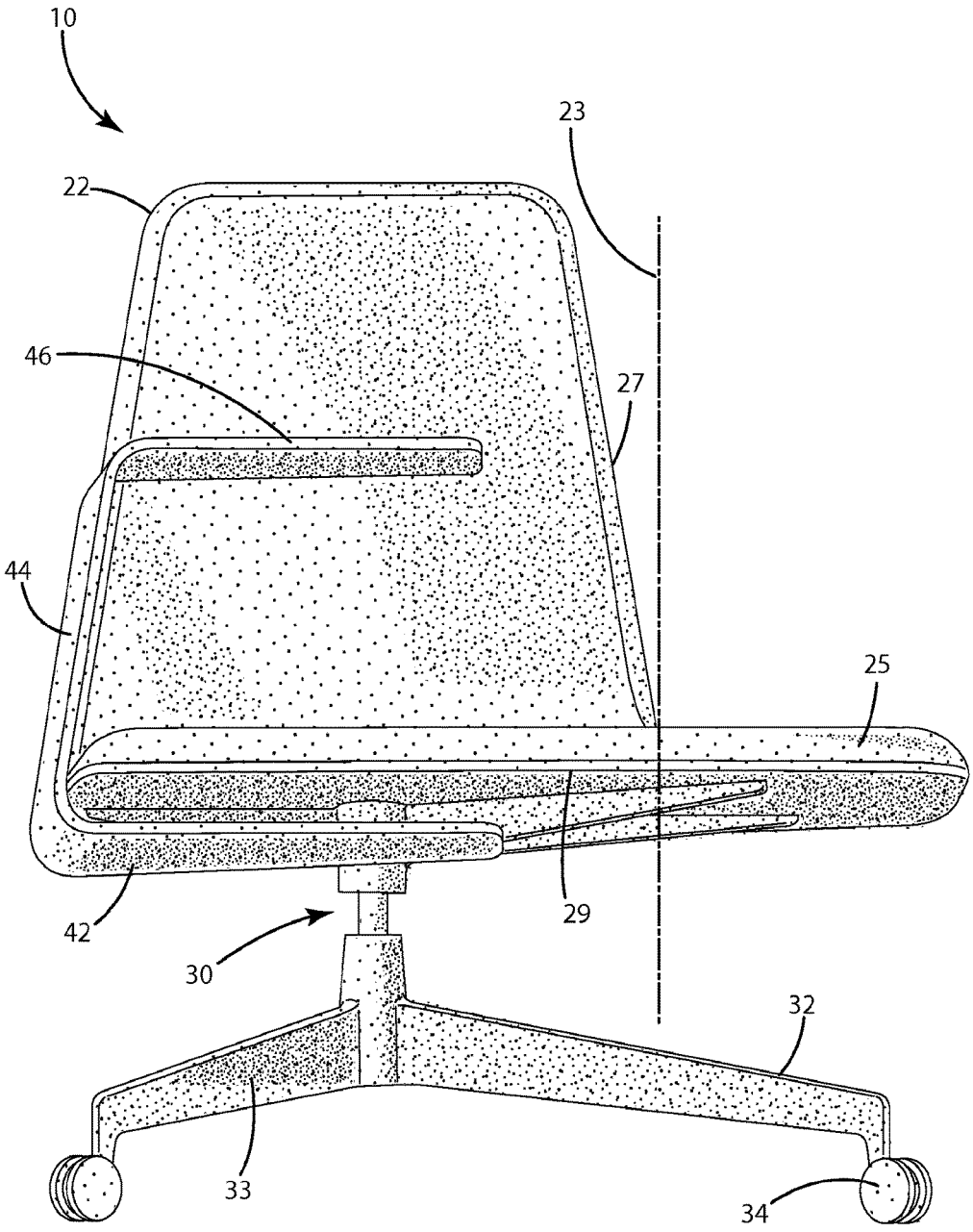
FIG. 12 is a front view of the chair assembly.

The seating unit may include more than one chair portion in a row if desired. For example the seating unit 400 shown in FIG. 5 includes center chair units 420 aligned in a row with an end chair 421 on each end. The end chairs 421 have a sitting surface 424 and a vertically extending back 422. The sitting surface 424 is adjacent a horizontally extended wing 425. Although not shown in FIG. 5, the extended wing 425 may include a cup holder. The end chairs 421 are both supported on a pedestal base 430 having legs 432 and glides 434. The end chair 421 is connected to the base 430 on the underside of the sitting surface 424. A beam 450 spans the distance between the bases 430 and supports the center chair portions 420 from below. The center chairs 420 and end chairs 421 of the seating unit 400 may be attached additionally or alternatively by known means aside from sharing a common support beam 450. The center chair portions 420 and the end chairs 421 including the extended wings 425 may be covered as described herein with respect to FIGS. 1-4.

Seating unit 400 may also alternatively include a sliding tray (not shown in FIG. 5) on one or both end chairs 421 in place of the extended wing 425. Alternatively, the seating unit 400 may include an extended wing 425 on one end chair 421 and a work desk on the opposite end chair 421.

The chair portions 20, 120, 320, 420, 421 and ottoman 50, 150 may be constructed from flat or formed plywood or from steel with molded foam. The sliding table 40, 140 and ottoman tray 60 may be constructed of flat or formed plywood or steel. The star bases 30, 54, 130, 154, 430 may be cast or extruded aluminum, plastic or other suitable metal or alloy with gliders of aluminum or plastic. The support beam 450 may be cast or extruded aluminum. The cut out for the cup holder 26, 226, 326 may be lined or filled with urethane, wood, cork, aluminum, leather, vinyl or other fabric or material as desired.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A seating unit comprising:
a chair portion with a sitting surface defining a sitting plane, a back extending vertically from said sitting surface;
a horizontally extended wing adjacent said sitting surface, said extended wing projecting in said sitting plane;
a base joined to an underside of said chair portion;
a work desk positioned to a side of said sitting surface opposite said horizontally extended wing;
wherein said sitting surface and said extended wing are divided along a line, said line originating on one end at a point where an edge of said of the back meets said sitting surface, and said line extends toward a front edge of said sitting surface.

2. The seating unit of claim 1 further comprising a pair of longer legs joined to the base and positioned vertically under said extended wing.

3. The seating unit of claim 2 further comprising at least one shorter leg joined to the base and positioned vertically under said sitting surface.

4. The seating unit of claim 2 wherein said sitting surface swivels on said base over a range of rotation.

5. The seating unit of claim 4 wherein said range of rotation is limited to maintain said extended wing vertically above at least one of said pair of longer legs.

6. The seating unit of claim 4 wherein said range of rotation is limited to an angle of between about 20 degrees to about 30 degrees.

7. The seating unit of claim 1 wherein said work desk further comprises a horizontal base, a vertical support on one end of said horizontal base and a cantilevered work surface attached to said vertical support.

8. The seating unit of claim 7 wherein said horizontal base is slidably joined to said underside of said chair portion.

9. The seating unit of claim 1 wherein the chair portion is at least in part upholstered with an anti-skid material.

10. A seating unit comprising:
a chair portion with a sitting surface defining a sitting plane, a back extending vertically from said sitting surface;
a horizontally extended wing adjacent said sitting surface, said extended wing projecting in said sitting plane;
a base joined to an underside of said chair portion;
a work desk positioned to a side of said sitting surface opposite said horizontally extended wing;
wherein a cup holder is defined within said horizontally extended wing of said sitting surface.

11. A seating unit comprising:
a chair portion including a horizontal sitting surface having a front edge, a rear edge opposite said front edge, and a pair of opposing side portions, said horizontal sitting surface defining a sitting plane, a back support extending vertically from said rear edge of said sitting surface, said back support extending at an angle to said sitting plane, said back support constrained between said opposing side portions of said sitting surface, said sitting surface defining a width between said opposing side portions;
a horizontally extended wing projecting outwardly from one of said side portions of said sitting surface to a distal edge, said wing projecting in said sitting plane, said wing defining a width less than about half of said width of said sitting surface;
a base joined to an underside of said chair portion, said base including a pedestal and a plurality of legs extending outwardly from said pedestal, a first pair of said legs extending in a direction toward said horizontally extended wing and a second pair of said legs extending in a direction away from said horizontally extended wing, said first pair of said legs being longer than said second pair of said legs, said first pair of said legs extending outwardly from said pedestal a sufficient distance such that a portion of at least one of said legs in said first pair of legs is vertically aligned underneath a portion of said horizontally extended wing; and a work desk positioned adjacent the side portion of said sitting surface opposite said horizontally extended wing.

* * * * *